US011289226B2

(12) United States Patent
Crichlow

(10) Patent No.: US 11,289,226 B2
(45) Date of Patent: Mar. 29, 2022

(54) NUCLEAR WASTE CAPSULE CONTAINER SYSTEM

(71) Applicant: Henry Crichlow, Norman, OK (US)

(72) Inventor: Henry Crichlow, Norman, OK (US)

( * ) Notice: Subject to any disclaimer, the term of this patent is extended or adjusted under 35 U.S.C. 154(b) by 936 days.

(21) Appl. No.: 16/191,390

(22) Filed: Nov. 14, 2018

(65) Prior Publication Data

US 2020/0027605 A1 Jan. 23, 2020

Related U.S. Application Data

(63) Continuation-in-part of application No. 15/936,245, filed on Mar. 26, 2018, now abandoned, and a continuation-in-part of application No. 15/480,504, filed on Apr. 6, 2017, now Pat. No. 10,427,191.

(60) Provisional application No. 62/736,252, filed on Sep. 25, 2018.

(51) Int. Cl.

| | |
|---|---|
| ***G21F 5/008*** | (2006.01) |
| ***G21F 9/34*** | (2006.01) |
| ***G21F 5/12*** | (2006.01) |

(52) U.S. Cl.

CPC ..... *G21F 5/008* (2013.01); *G21F 5/12* (2013.01); *G21F 9/34* (2013.01)

(58) Field of Classification Search

CPC ... G21F 5/008; G21F 9/34; G21F 5/12; G21F 9/36; G21F 5/06; G21F 5/005

See application file for complete search history.

(56) References Cited

U.S. PATENT DOCUMENTS

| | | | | |
|---|---|---|---|---|
| 5,850,614 | A | 12/1998 | Crichlow | |
| 6,238,138 | B1 | 5/2001 | Crichlow | |
| 6,654,704 | B2 | 11/2003 | Wager | |
| 7,047,134 | B2 | 5/2006 | Berger | |
| 8,055,547 | B2 | 11/2011 | Kelly | |
| 8,117,138 | B2 | 2/2012 | Apte | |
| 8,933,289 | B2 | 1/2015 | Crichlow | |
| 2004/0067328 | A1* | 4/2004 | Taniuchi | C04B 22/064 428/34.4 |
| 2008/0010792 | A1* | 1/2008 | Pryd-Kakuk | A61G 17/08 27/1 |
| 2008/0207977 | A1* | 8/2008 | Peterson | G21F 9/36 588/3 |
| 2012/0221366 | A1 | 8/2012 | Bowman | |
| 2018/0182505 | A1* | 6/2018 | Diefenbach | G21F 9/24 |

* cited by examiner

*Primary Examiner* — Michael C Zarroli
(74) *Attorney, Agent, or Firm* — Eric Kelly

(57) ABSTRACT

Capsule systems and methods for long-term storage and/or disposal of high-level nuclear waste in deep geologic formations are described. Such systems and methods may include waste-capsules constructed substantially from granite or similar igneous rock material into which the nuclear waste material is placed before capsule insertion into a geologically deep wellbore.

20 Claims, 9 Drawing Sheets

NOT TO SCALE

NUCLEAR WASTE CAPSULE CONTAINER SYSTEM

PRIORITY NOTICE

The present application claims priority under 35 U.S.C. § 119(e) to U.S. Provisional Patent Application Ser. No. 62/736,252 filed on Sep. 25, 2018, the disclosure of which is incorporated herein by reference in its entirety.

The present patent application is a continuation-in-part (CIP) of U.S. non-provisional patent application Ser. No. 15/936,245 filed on Mar. 26, 2018, and claims priority to said U.S. non-provisional patent application under 35 U.S.C. § 120. The preceding identified U.S. non-provisional patent application is incorporated herein by reference in its entirety as if fully set forth below.

The present patent application is a continuation-in-part (CIP) of U.S. non-provisional patent application Ser. No. 15/480,504, filed on Apr. 6, 2017, and claims priority to said U.S. non-provisional patent application under 35 U.S.C. § 120. The preceding identified U.S. non-provisional patent application is incorporated herein by reference in its entirety as if fully set forth below.

CROSS REFERENCE TO RELATED PATENTS

The present application is related to previous patents by the same inventor related to the disposal of nuclear waste in deep underground formations. These patents are: U.S. Pat. Nos. 5,850,614, 6,238,138, and 8,933,289. The disclosures of all of these patents are all incorporated herein by reference in their entirety.

TECHNICAL FIELD OF THE INVENTION

The present invention generally relates to disposing of nuclear waste and more particularly, to: (a) the operations of nuclear waste disposal; and (b) utilization of specialized capsules or containers of granite or the like for nuclear waste which may be sequestered in lateral wellbores drilled into deep geologic formations, such that, the nuclear waste is disposed of safely, efficiently, economically and also, if required, may be retrieved for technical or operational reasons.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Today (circa 2018) there is an enormous quantity of nuclear waste accumulating across the world (Earth). In the US alone there are more than 90,000 metric tons (MT) of high-level solid waste (HLW) being stored in cooling pools and in concrete casks on the Earth's surface. These surface operations are very costly typically costing hundreds of millions of dollars annually, if not more, and growing. The HLW is generally called spent nuclear fuel (SNF) and consists of thousands of nuclear fuel assemblies which have been removed from operating nuclear power plants. There is also a relatively small amount of weapons-grade plutonium (WGP) from the non-operational nuclear weapons programs.

These nuclear waste products and devices are highly radioactive and also thermally active and continue to generate sensible heat which must be safely removed, mitigated, accounted for, and/or appropriately dealt with. Presently, this may be substantially handled by maintaining these nuclear waste products and devices in cooling tanks at the onsite surface storage sites. There are approximately 80,000 individual fuel assemblies being stored today in the US and about 15,000 MT (metric tons) being added annually. There is a significant need for new mechanisms and processes to safely move away from such surface storage of this radioactive waste and to sequester this SNF waste safely.

Today, many nuclear power generating countries are implementing or researching the disposal of HLW in granitic formations.

For example, Canada has restarted the repository siting program; Finland is scheduled to open that nation's first HLW repository in granite in 2020; Japan is pursuing voluntary candidate repository sites with an expressed interest in granite; Sweden is scheduled to open that nation's first repository for HLW in granite in 2025; the United States of America has operated testing sites in granite.

In this application "HLW" and "SNF" may be used interchangeably to describe or refer to solid nuclear waste product(s). In this application, the terms "capsule" and "canister" may be used interchangeably with the same meaning.

It shall be shown that the preferred capsule system taught herein has a granite or granite type rock of igneous origin, a container core needed to support the capsule and its contents over a considerable period of time, such as geologic time, and minimize the negative effects of any structural deterioration of the capsule system. Granite and granite type rock descriptions are used interchangeably in this application for rocks of substantially igneous origin.

Accordingly, it is desirable and advantageous to provide improved materials and simple techniques that offer a better, more durable, and cost-effective solution for the long-term storage of nuclear waste products.

Improved materials and techniques shall enhance the safety of handling, transportation, and long-term disposal containment of HLW as well as protect human health and protect the environment before, during, and after the emplacement of the HLW containing capsules.

Granite is a class of rocks. Granite may be a crystalline igneous rock that encompasses a variety of specific lithologies. Granite may be formed from magma that intruded other rock formations deep within the continental crust. Granite may predominantly comprise quartz and feldspar. Granite deposits are widespread across the world, and major commercial operations have been involved in quarrying and producing vast quantities of granite for commercial use. Granite is available in huge quantities and in multiple countries around the world. Granite can be procured in various quality and compositions.

There is a technical basis for the use of granite in the nuclear waste capsule development. Scientists have preferred the use of granite disposal of HLW in a repository deep in a granite formation since it is expected to provide effective long-term (>$10^6$ years) isolation of radionuclides from the biosphere because of mechanical, hydrologic, and chemical properties of granite. Different variations of granite are found in nature, and the optimal type may be selected based on the composition and favorable structural, mechanical, petrophysical properties, and machinability of the given granite variant.

These attributes of: low permeability; mechanical stability; favorable chemical environment, e.g., a reducing environment that would limit corrosion; and appropriate geologic setting, such as siting the repository at least 15,000 feet beneath the land's surface, may be desired attributes for nuclear waste long-term storage (disposal) solutions. For example, at this depth, fractures may be generally sparse in igneous rocks, and hydraulic conductivity may be low. Also, at these depths, there may be no groundwater circulation to create corrosion, erosion, or leaching problems.

Additionally, there is a minimal chance of thermal cracking of the granite in the deep repository since the expected temperatures of the repository are below the levels that would create thermal cracking of the granite material.

There is a need in the art for nuclear waste long-term storage (disposal) solutions that utilize deep geologic formations which through wellbores may receive waste-capsules substantially constructed of granite (or the like) for holding the nuclear waste materials.

It is to these ends that the present invention has been developed.

BRIEF SUMMARY OF THE INVENTION

To minimize the limitations in the prior art, and to minimize other limitations that will be apparent upon reading and understanding the present specification, embodiments of the present invention may describe systems and methods for storage of nuclear waste into closed and deep geological formations, using waste-capsules which may contain HLW, WGP, SNF, and/or their derivatives.

The present invention is concerned with disposing of nuclear waste and, more specifically, to methods and systems of disposing of encapsulated nuclear waste in deep underground closed rock formations using multilateral horizontal boreholes connected to the surface by a vertical wellbore. More specifically, the invention describes methods and systems in which a novel capsule system and the attendant internment methodology are illustrated to provide effective safety for the long-term nuclear geologic waste repository. Granite rock deposits from which the commercial granite material is quarried have been shown to be over one billion years old and remain intact today. Also, this structural material of granite is very inexpensive and today (2018) sells for between $650 and $1,400 (US dollars) per cubic meter.

Since it is universally accepted in all published national and international reports and studies, that granite provides a suitable medium for the long-term internment of HLW, an object of this invention may be to construct a "miniature" nuclear waste repository system on the surface, as a capsule, using granite. Then, to insert the waste into the "miniature repository" capsule and "land" this novel capsule system in a deep horizontal wellbore away from the biosphere. Landing being the industry operational term for inserting and fixing a downhole piece of equipment or apparatus in a wellbore.

Another object of the present invention may be to provide a method of disposing of nuclear waste in a capsule system that is generally accepted as being capable of very long-term survival.

In some embodiments, a method may provide an operational method for fabricating at least one nuclear waste capsule. In this operational method, the recommended tasks involved provide a more efficient methodology to allow safer, more economical, and long lasting disposal of the nuclear waste in the deep underground repositories.

In some embodiments, a very significant existing consideration must be addressed in the long-term nuclear waste disposal process. This consideration may be the eventual degradation of the physical integrity of the wellbore system components. Some mechanisms may be needed to minimize the degradation. A long-lived technology system may be required to guarantee within technical certainty that the HLW can be contained adjacent and within the repository zone.

The current invention teaches an improved engineered barrier system implemented in this application.

The mechanical and physical wellbore outer protective layers; outer cement, outer steel pipes, inner cement, inner steel pipes; in this application, all will degrade over varying time horizons. The contemplated inner-most core material, granite (or the like), has been historically demonstrated in the geological record, to be an effective barrier for millions of years. In numerical terms, the cement and steel may degrade in 2,000 to 10,000 years. However, the granite (or the like) enclosed central nuclear waste core shall be protected for hundreds of thousands of years from contact with the biosphere. The combination of these two features sequentially allows for hundreds of thousands of years of radioactive protection of the biosphere from the effects of radionuclides in the waste materials. After this time period, the high level waste radioactivity would have significantly decreased and the material may be essentially harmless.

The preceding and other objects, advantages and characterizing features will become apparent from the following description of certain illustrative embodiments of the invention.

The novel features which are considered characteristic for the invention are set forth in the appended claims. Embodiments of the invention itself, however, both as to its construction and its method of operation, together with additional objects and advantages thereof, will be best understood from the following description of the specific embodiments when read and understood in connection with the accompanying drawings. Attention is called to the fact, however, that the drawings are illustrative only, and that changes may be made in the specific construction illustrated and described within the scope of the appended claims.

These and other advantages and features of the present invention are described herein with specificity to make the present invention understandable to one of ordinary skill in the art, both concerning how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

REFERENCE NUMERAL SCHEDULE

Figure 1:
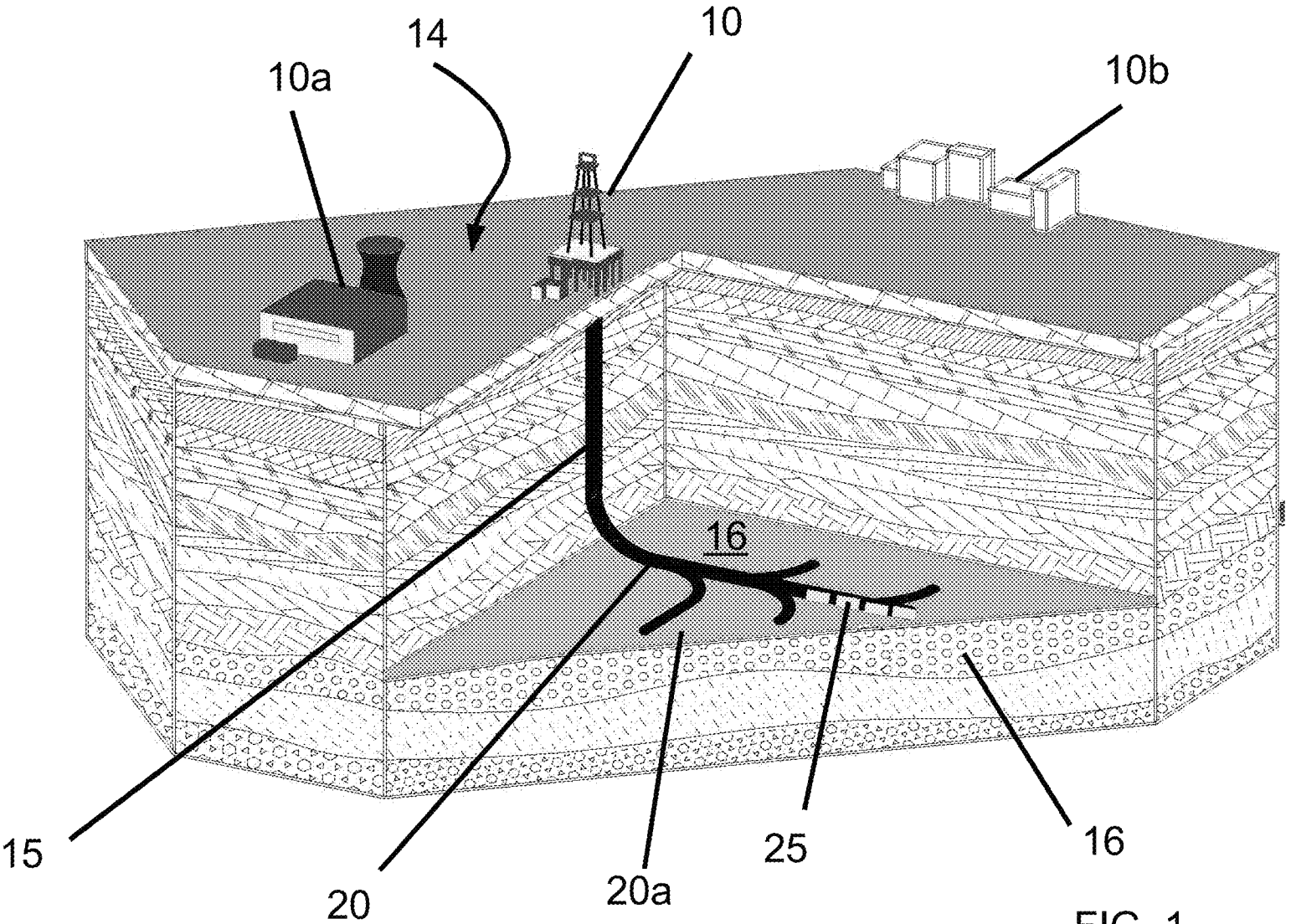
FIG. 1 may illustrate an overview of the deep underground nuclear waste repository system.

10 drilling-rig 10
10*a* nuclear power plant 10*a*
10*b* surface-storage-locations 10*b*
14 earth surface 14
15 vertical-wellbore 15
16 deep disposal formation 16
19 granite block 19
19*a* granite block dimension 19*a*
19*b* granite block dimension 19*b*
19*c* granite block dimension 19*c*
20 primary lateral wellbore 20
20*a* secondary lateral wellbore 20*a*
24*a* drilled out void space 24*a*
24*b* granite core cylinder 24*b*
24*c* granite cap 24*c*
24*d* solid support base 24*d*
24*e* connection means of cap and container 24*e*
24*f* inner alloy liner with closed bottom 24*f*
24*g* outer lining of cylinder with closed bottom 24*g*
24*h* granite rectangular prism 24*h*
25 waste-capsule 25 (for HLW, WGP and/or SNF)
26 coring device 26
30*a* cement 30*a* (between inner and outer pipes)
30*b* cement 30*b* (between outer pipe and formation)
31 outer pipe 31
33 inner pipe 33
34 carrier tube 34 (for HLW, WGP and/or SNF)
36 nuclear waste material 36
38 geologic formation 38
40 coupling 40
40*a* guiding tool 40*a*
40*c* landing tool 40*c*
40*b* detachable tool 40*b*
800 method of nuclear waste long-term storage using granite capsules 800
801 step of cutting and preparing granite block 801
802 step of drilling inner core (void space) in granite block 802
803 step of drilling outer core of granite 803
805 step of cutting granite rectangular prism with support base forming granite waste-capsule 805
806 step of quality control check for fractures in granite waste-capsule 806
807 step of making granite cap for granite waste-capsule 807
808 step of installing metal tube inside inner granite waste-capsule 808
809 step of filling granite waste-capsule with nuclear waste material 809
810 step of closing the inner metal tube 810
811 step of sealing granite waste-capsule with granite cap 811
812 step of adding outer metal tube around granite waste-capsule 812
813 step of sealing the outer metal tube 813
814 step of inserting granite waste-capsule into carrier tube 814
815 step of iteratively joining several carrier tubes to form chorizo, and performing iterative operations to load chorizo sequentially into wellbores 815
816 step of harvesting nuclear waste material 816
817 step of processing nuclear waste material for encapsulation 817

DETAILED DESCRIPTION OF THE INVENTION

In this patent application HLW (high-level solid waste), SNF (spent nuclear fuel), and WGP (weapons-grade plutonium) may be used interchangeably in reference to nuclear waste materials and/or their derivatives to be disposed of and/or stored long-term.

In this patent application the terms "capsule," "container" and "canister" may be used interchangeably with the same meaning.

In this patent application the terms "tube" and "pipe" may be used interchangeably and may refer to cylindrical elements implemented in the design and installation processes of some embodiments of the present invention.

Note, unless an explicit reference of "vertical wellbore" or "lateral wellbore" (i.e., "horizontal wellbore") accompanies "wellbore," use of "wellbore" herein without such explicit reference may refer to vertical wellbores or lateral wellbores, or both vertical and lateral wellbores.

In this patent application, the terms "wellbore" and "borehole" may be used interchangeably. In some embodiments, initial lateral borehole may be an example of primary lateral wellbore 20. In some embodiments, the lateral borehole may be an example of secondary lateral wellbore 20*a*. See e.g., FIG. 1 for primary lateral wellbore 20 and secondary lateral wellbore 20*a*. Also, "wellbore metrics" may refer to parameters that may define a given wellbore such as, but not limited to, diameter, length, and azimuth.

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized and changes may be made without departing from the scope of the invention.

FIG. 1 may illustrate an inclusive overview of a deep geologic nuclear waste disposal system and/or process. A surface drilling-rig 10*a* may be apparatus that drills vertical-wellbore 15, primary lateral wellbore 20, and/or secondary lateral wellbore 20*a*; and into which the waste-capsule(s) 25 (e.g., carrier tube(s) 34) may be disposed of in deep-geological-formation 16 (e.g., geologic formation 38). In some embodiments, deep-geological-formation 16 may be located substantially from about 5,000 feet to about 30,000 feet below a terrestrial surface (e.g., earth surface 14), plus or minus 1,000 feet. In some embodiments, deep-geological-formation 16 may have geologic properties that make storing nuclear materials relatively safe and thus desirable. For example, and without limiting the scope of the present invention, in some embodiments, deep-geological-formation 16 may have one or more of the following geologic properties: structural closure, stratigraphically varied, low porosity, low permeability, low water saturation, reasonable clay content, and/or the like. For example, and without limiting the scope of the present invention, in some embodiments, primary lateral wellbore 20 may be located at a predetermined depth of at least 10,000 feet below the surface (e.g., earth surface 14). In some embodiments, waste-capsule 25 may store (e.g., contain) HLW (high-level solid waste) and/or SNF (spent nuclear fuel) or WGP products. Associated usually, but normally at distant remote locations, may be nuclear power plant 10*a*; and/or surface-storage-locations 10*b* for surface nuclear waste storage. In some embodiments, drilling-rig 10 may be a typical drilling rig as used in the oil-well drilling industry but with several updated modifications and features to allow safe handling of the radioactive waste (such as, HLW, WGP and/or SNF).

Continuing discussing FIG. 1, in some embodiments, while at least some portions of vertical-wellbore 15 may be substantially vertical with respect to a surface of the earth (e.g., earth surface 14), at least some portions of primary lateral wellbore 20 may be substantially horizontal. In some embodiments, one or more primary lateral wellbores 20 may emanate (e.g., derive) from vertical-wellbore 15. In some embodiments, one or more secondary lateral wellbores 20*a* may emanate (e.g., derive) from primary lateral wellbores 20. In some embodiments, one or more waste-capsules 25 may be located, placed, and/or stored in one or more of primary lateral wellbores 20, secondary lateral wellbores 20*a*, and/or vertical-wellbores 15. In some embodiments, drilling-rig 10 may be used to form one or more of vertical-wellbores 15, primary lateral wellbores 20, and/or secondary lateral wellbores 20*a*.

Continuing discussing FIG. 1, in some embodiments, one or more of vertical-wellbores 15, primary lateral wellbores 20, and/or secondary lateral wellbores 20*a* may have predetermined diameters. For example, and without limiting the scope of the present invention, in some embodiments such wellbore diameters may be selected from the range of substantially six inches to substantially 48 inches, plus or minus one inch.

Continuing discussing FIG. 1, in some embodiments, one or more of vertical-wellbores 15, primary lateral wellbores 20, and/or secondary lateral wellbores 20*a* may have predetermined lengths. For example, and without limiting the scope of the present invention, in some embodiments such lengths may be selected from the range of substantially five hundred feet to substantially twenty-five thousand feet.

Figure 2:
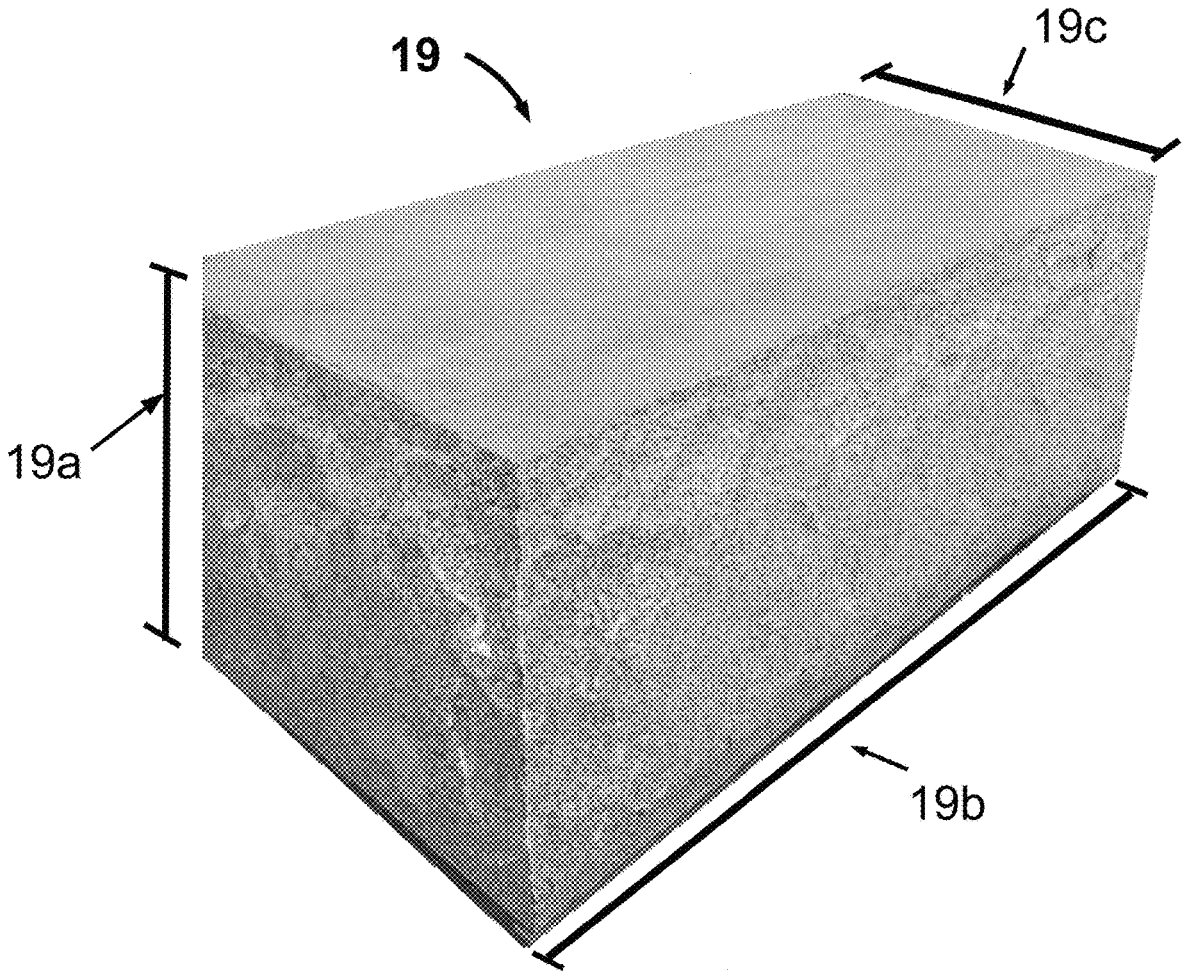
FIG. 2 may illustrate a commercial granite block as quarried and prepared for use in that industry.

FIG. 2 may illustrate a large block of granite 19 or similar igneous rock which has been quarried (e.g., from a commercial source[quarry]). In some embodiments, granite 19 may be a granite block that may be shaped and/or prepared for use in the coring processes to be discussed later in this patent application. In some embodiments, granite block 19 may have a length 19*b*, a width 19*c*, and a height 19*a*. For example, and without limiting the scope of the present invention, granite block 19 may have length 19*b* of about 2.5 meters (95 inches), width 19*c* of about 1.0 meter (39 inches), and height 19*a* of about 1.2 meters (47 inches).

Figure 3A:
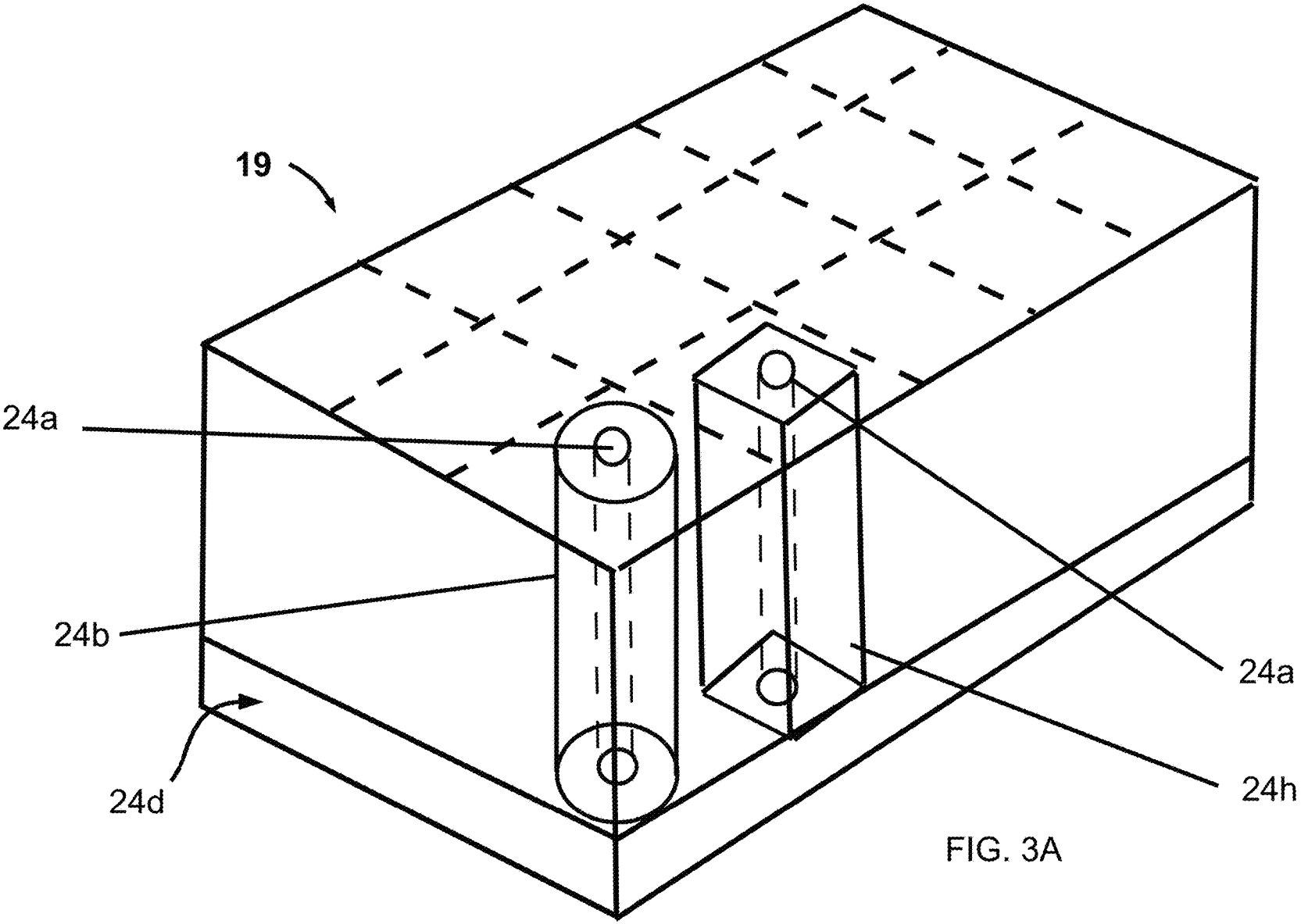
FIG. 3A may illustrate the circular coring process of the granite block to construct the granite waste-capsules and the cutting of the granite block into a cylindrical and or squarish (e.g., rectangular prism) structures.

FIG. 3A may illustrate the process by which granite block 19 may be cored using a coring device 26 (see FIG. 3B for coring device 26) to form a given granite core cylinder 24*b*. In some embodiments, an initial coring operation may produce an drilled out void space 24*a* in the granite block 19. In some embodiments, an inner diameter of drilled out void space 24*a* may be substantially six inches. In some embodiments, sequential to the initial coring operation that may generate drilled out void space 24*a*, a further larger coring operation may be performed to cut and generate granite core cylinder 24*b*. In some embodiments, an outer diameter of granite core cylinder 24*b* may be substantially eight inches. In some embodiments, an outer diameter of granite core cylinder 24*b* may be greater than the inner diameter of drilled out void space 24*a*. In some embodiments, these inner coring and outer coring operations may be concentric with respect to each other. That is, in some embodiments, drilled out void space 24*a* and granite core cylinder 24*b* may be both cylindrical and concentric with each other, i.e., sharing a same central axis. In some embodiments, disposed between drilled out void space 24*a* and an outer exterior portion of granite core cylinder 24*b* may be a solid region of granite. In some embodiments, granite core cylinder 24*b* may be longer than drilled out void space 24*a*. In some embodiments, granite core cylinder 24*b* may have a length of granite block 19 height dimension 19*a*. In some embodiments, additional length of granite core cylinder 24*b* beyond the length of drilled out void space 24*a* may be a region of sold granite, designated as solid support base 24*d*. In some embodiments, the end result of these two coring operations may be granite container, that may be designated as waste-capsule 25 or as granite core cylinder 24*b*, with drilled out void space 24*a* and with solid support base 24*d*.

Continuing discussing FIG. 3A, in some embodiments, the formed granite container (e.g., waste-capsule 25) may have an outer shape that is not cylindrical. In some embodiments, the formed granite container (e.g., waste-capsule 25) may have an outer shape that may be substantially a rectangular prism, see e.g., granite rectangular prism 24*h* being formed from granite block 19 in FIG. 3A. In some embodiments, such a substantially shaped granite rectangular prism 24*h* may still have drilled out void space 24*a* and have solid support base 24*d*.

Figure 3B:
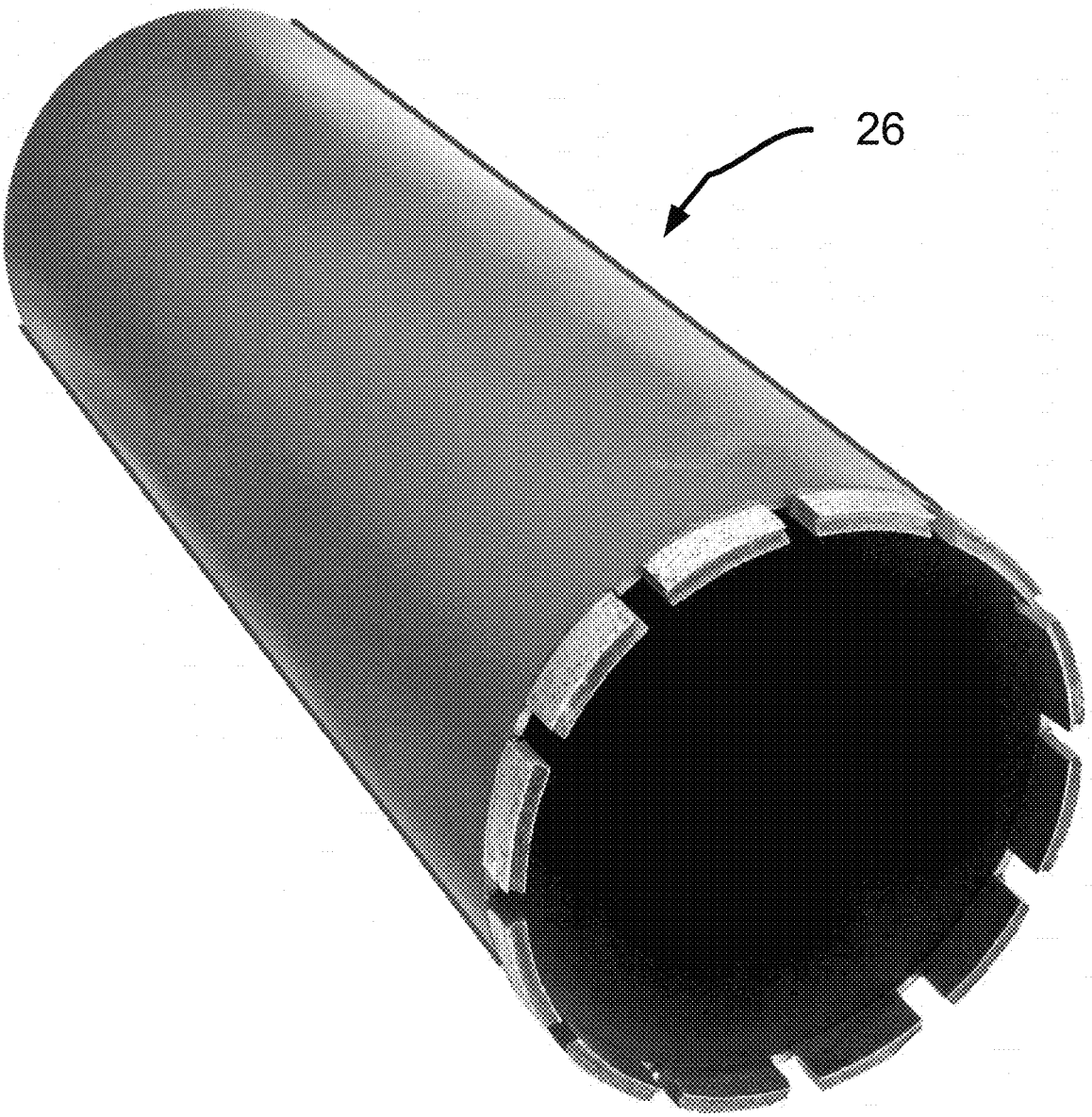
FIG. 3B may illustrate a commercially available coring device used to core granite blocks.

FIG. 3B may depict commercially available coring device 26 used in coring operations of granite 19. In some embodiments, coring device 26 may have hard edged cutting surfaces (e.g., diamond tipped or the like) to make the coring (drilling) cuts into granite block 19 resulting in drilled out void space 24*a* and/or granite core cylinder 24*b*. In some embodiments, different sized coring devices 26 may be used to generate drilled out void space 24*a* and granite core cylinder 24*b*.

In some embodiments, exterior surfaces of granite rectangular prism 24*h* shown being formed in FIG. 3B may be cut using cutting tools configured to cut granite.

In some embodiments, the granite containers that may be waste-capsules 25 may be shaped, cut, and/or at least partially formed using high pressure water cutting jets.

Figure 4:
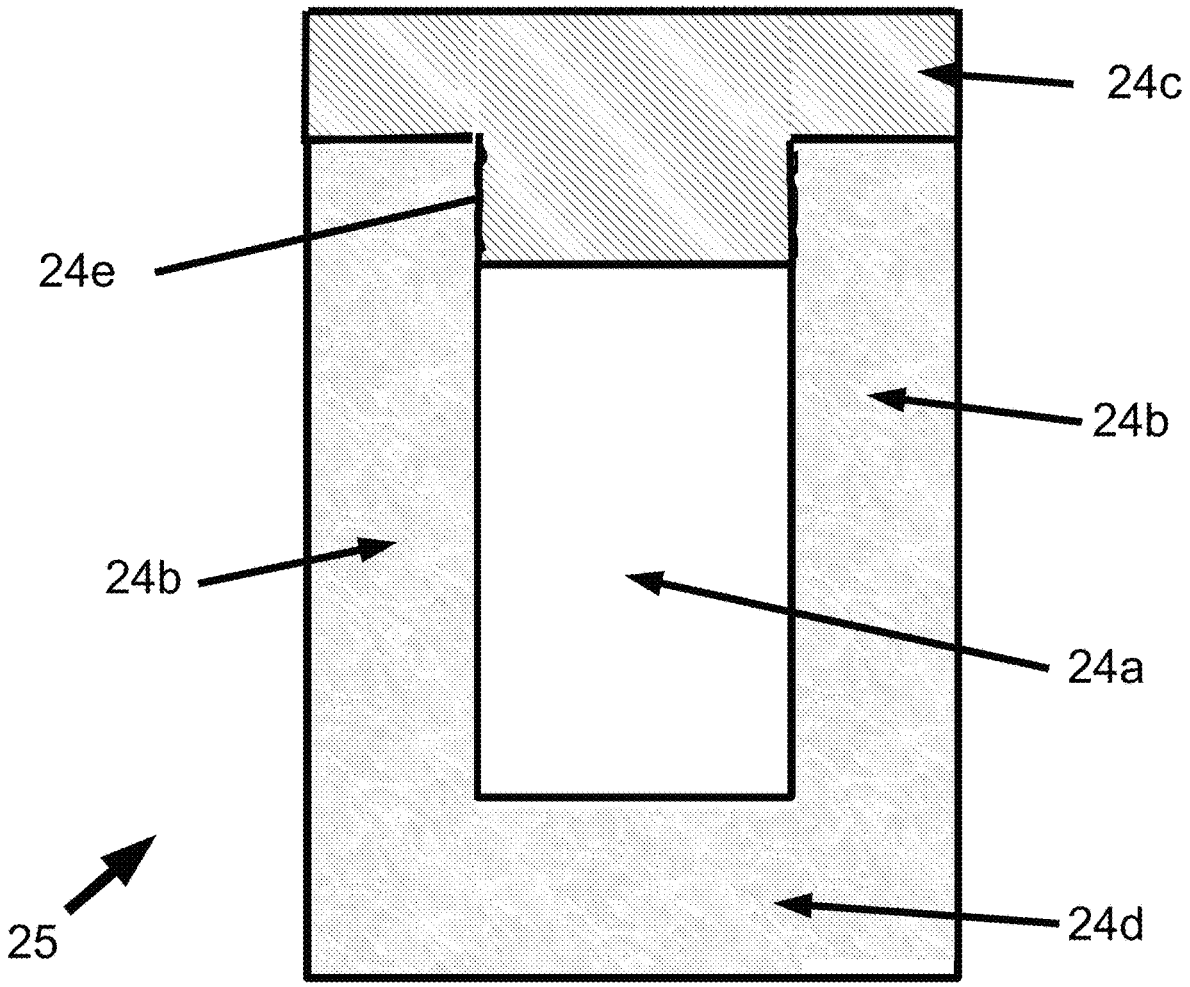
FIG. 4 may illustrate the granite waste-capsule with a granite cap installed and where the nuclear waste material may be stored inside this (cylindrical in some embodiments) granite waste-capsule.

FIG. 4 may partially illustrate a vertical cross-section of a granite based waste-capsule 25. In some embodiments, waste-capsule 25 may comprise a bottom (e.g., solid support base 24*d*), side walls (e.g., granite core cylinder 24*b*), and a top (e.g., granite cap 24*c*) that all may be substantially constructed from granite. In some embodiments, granite core cylinder 24*b* may extend perpendicularly away from solid support base 24*d*. In some embodiments, the bottom (e.g., solid support base 24*d*), the side walls (e.g., granite core cylinder 24*b*), and the top (e.g., granite cap 24*c*) may all be substantially disposed around drilled out void space 24*a*. In some embodiments, the granite based waste-capsule 25 may comprise drilled out void space 24*a* in which may be placed the nuclear waste material 36 and/or its derivatives to be stored (disposed of) long-term. In some embodiments, nuclear waste material 36 and/or its derivatives may be one or more of HLW/SNF/WGP, and/or the like. In some embodiments, granite core cylinder 24*b* and solid support base 24*d* may be integral with respect to each other, formed from a single continuous piece of granite block 19. In some embodiments, granite core cylinder 24*b* and solid support base 24*d* may provide structural support to waste-capsule 25. In some embodiments, waste-capsule 25 may comprise granite cap 24*c*. In some embodiments, granite cap 24*c* may be substantially constructed from granite. In some embodiments, granite cap 24*c* may be a cap to provide closure to waste-capsule 25, sealing drilled out void space 24*a*. In some embodiments, granite cap 24*c* may be machined, shaped, cut, and/or formed from a single piece of granite. In some embodiments, granite cap 24*c* may be shaped and/or sized to fit the opening of drilled out void space 24*a* so that this opening may be plugged. In some embodiments, granite cap 24*c* may be shaped and/or sized to fit a top of granite core cylinder 24*b*. In some embodiments, granite cap 24*c* may be attached to a top of granite core cylinder 24*b*. In some embodiments, such attachment may be facilitated by connection means of cap and container 24*e*. In some embodiments, such attachment may be removable.

In some embodiments, waste-capsule 25 may comprise two opposing terminal ends (e.g., a bottom of solid support base 24*d* and a top of granite core cylinder 24*b* or a top of granite top 24*c*). In some embodiments, waste-capsule 25 may be an elongate member. In some embodiments, waste-capsule 25 may be a substantially cylindrical member. In some embodiments, waste-capsule 25 may be rectangular in cross-section.

Figure 5:
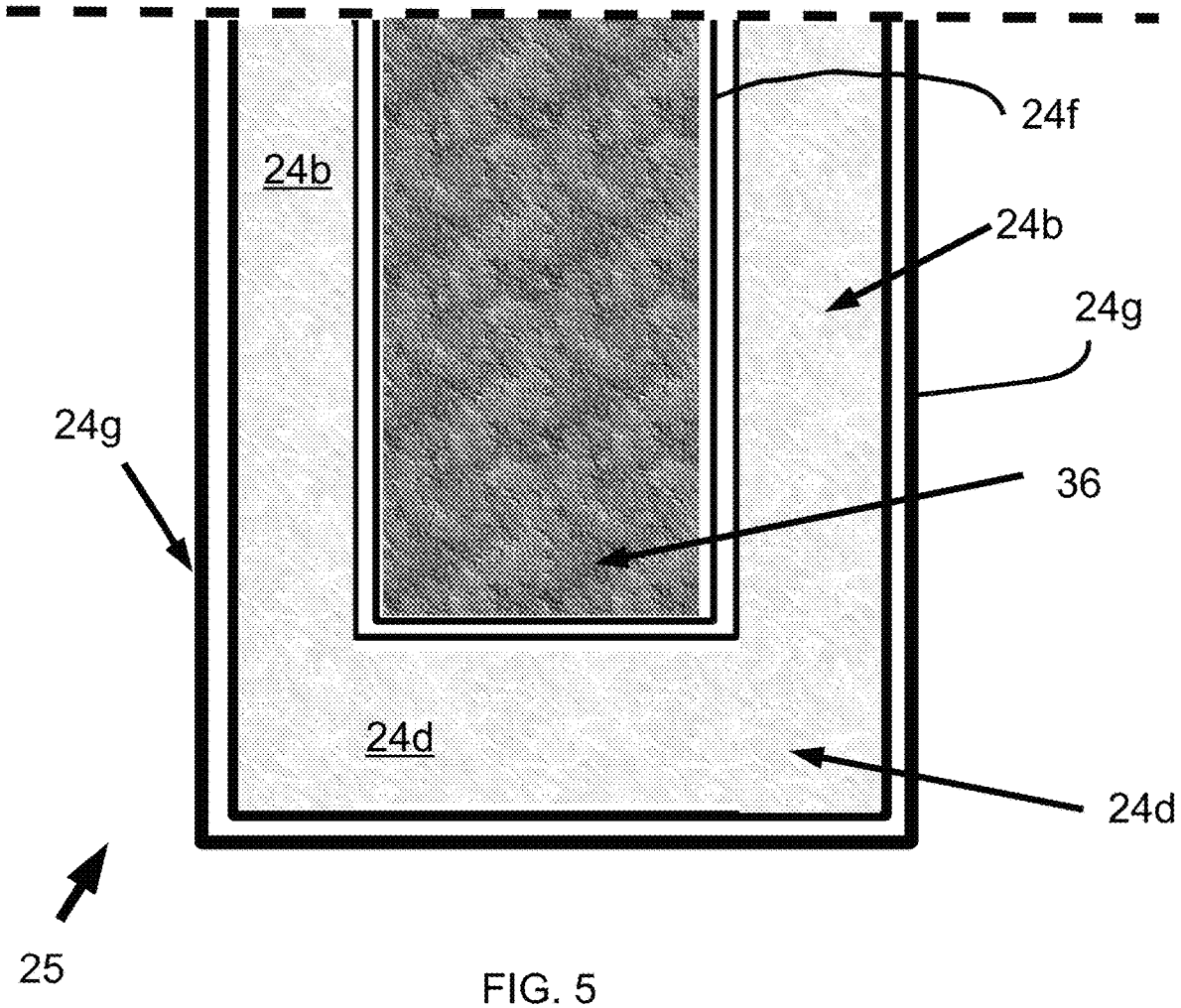
FIG. 5 may illustrate a partial view showing optional additions of inner and outer metal alloy tubes in the inside of the granite waste-capsule and on the outside of granite waste-capsule system.

FIG. 5 may illustrate a partially truncated vertical section of waste-capsule 25 in a similar vertical cross-sectional view as seen in FIG. 4. FIG. 5 may depict some additional structures of the substantially granite waste-capsule 25 of FIG. 4 that may be added to the given granite waste-capsule 25 in some embodiments. In some embodiments, waste-capsule 25 may further comprise inner alloy liner with closed bottom 24*f*. In some embodiments, inner alloy liner with closed bottom 24*f* may be configured to fit substantially within drilled out void space 24*a*. In some embodiments, inner alloy liner with closed bottom 24*f* may substantially fit snugly within drilled out void space 24*a*. In some embodiments, inner alloy liner with closed bottom 24*f* may receive nuclear waste material 36. In some embodiments, use of inner alloy liner with closed bottom 24*f* may reduce friction problems and/or other loading problems of loading nuclear waste material 36 into drilled out void space 24*a*. In some embodiments, inner alloy liner with closed bottom 24*f* may be substantially constructed from a metal and/or a metal alloy. In some embodiments, inner alloy liner with closed bottom 24*f* may be substantially constructed from a long-lived corrosion resistant metal and/or a metal alloy. In some embodiments, inner alloy liner with closed bottom 24*f* may be substantially constructed from a long-lived corrosion resistant metal and/or a metal alloy, such as, but not limited to, copper. In some embodiments, after placing nuclear waste material 36 within inner alloy liner with closed bottom 24*f*, any open end of inner alloy liner with closed bottom 24*f* may be closed and/or sealed by mechanical means.

Continuing discussing FIG. 5, in some embodiments, waste-capsule 25 may further comprise outer lining of cylinder with closed bottom 24*g*. In some embodiments, outer lining of cylinder with closed bottom 24*g* may substantially surround, encapsulate, and/or enclose the granite components of waste-capsule 25. In some embodiments, outer lining of cylinder with closed bottom 24*g* may completely surround, encapsulate, and/or enclose the granite components of waste-capsule 25. In some embodiments, encapsulating the granite components of waste-capsule 25 within outer lining of cylinder with closed bottom 24*g* may facilitate loading such an encapsulated waste-capsule 25 into carrier tube 34 (or into inner pipe 33). In some embodiments, outer lining of cylinder with closed bottom 24*g* may be substantially constructed from a metal and/or a metal alloy.

Figure 6:
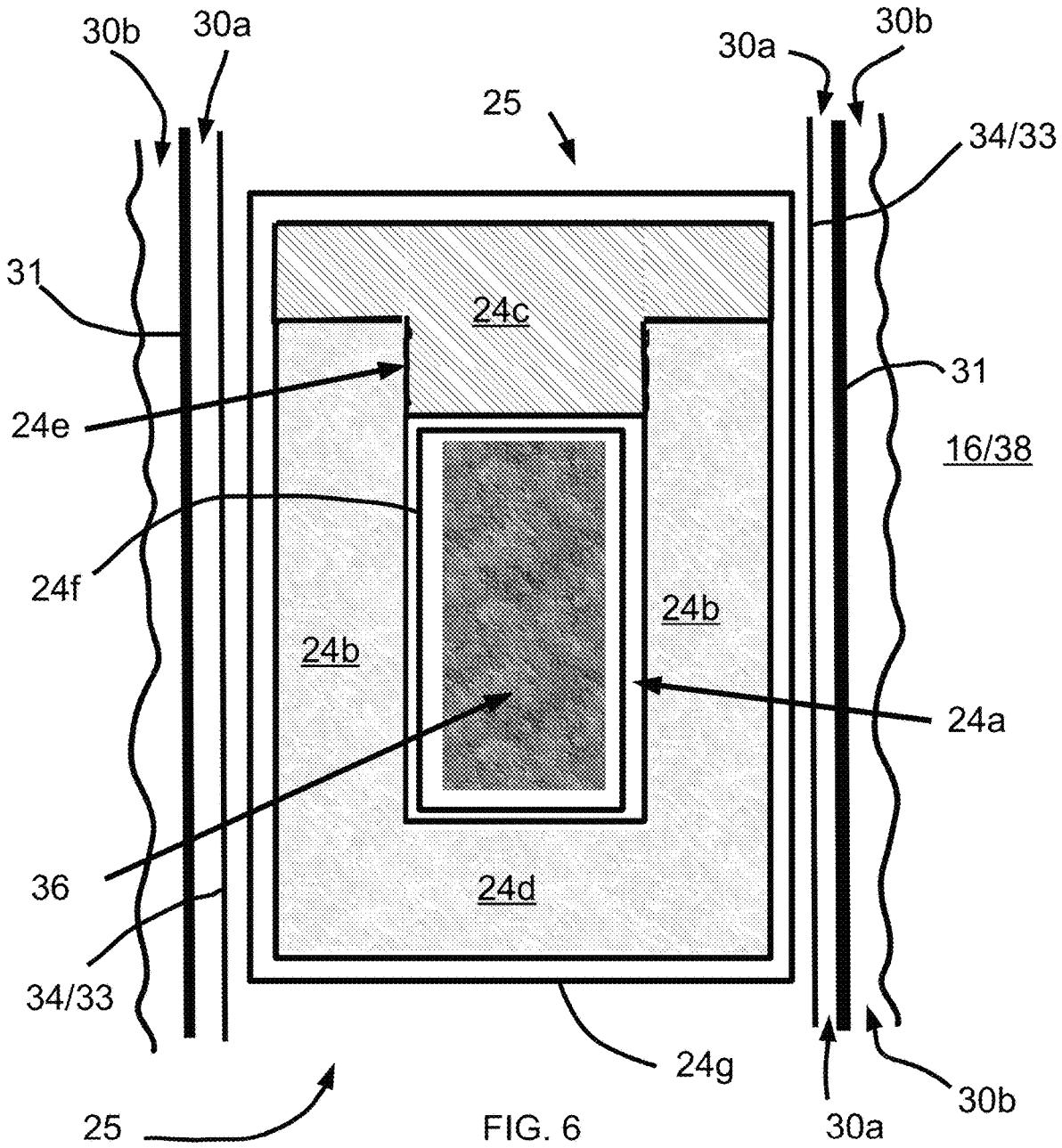
FIG. 6 may schematically illustrate a version of a complete granite waste-capsule system installed in a wellbore system.

FIG. 6 may illustrate a vertical section of the waste-capsule 25 of FIG. 5 with some additional structures, in a similar vertical cross-sectional view as seen in FIG. 4 and in FIG. 5. In FIG. 6 the waste-capsule 25 of FIG. 5 may be shown inserted into carrier tube 34 (or into inner pipe 33); and carrier tube 34 (or inner pipe 33) may be inserted into a given wellbore (e.g., 15, 20, and/or 20*a*); and this section of the given wellbore may itself be within deep disposal formation 16 and/or geologic formation 38. In some embodiments, disposed between the interior surfaces of deep disposal formation 16 and/or geologic formation 38 may be outer pipe 31. In some embodiments, disposed within outer pipe 31 may be carrier tube 34 (or inner pipe 33) with the waste-capsule 25 of FIG. 5. In some embodiments, disposed between the interior surfaces of deep disposal formation 16 and/or geologic formation 38 and outer pipe 31 may be injected cement 30*b*. In some embodiments, disposed between outer pipe 31 and carrier tube 34 (or inner pipe 33) with the waste-capsule 25 of FIG. 5 may be injected cement 30*a*. In some embodiments, outer pipe 31, inner pipe 33, and/or carrier tube 34 may be substantially constructed from a metal or metal alloy, such as, but not limited to steel. In some embodiments, outer pipe 31, inner pipe 33, and/or carrier tube 34 may be a steel piping system and/or a steel casing system.

Continuing discussing FIG. 6, in some embodiments, nuclear waste material 36 may be first sealed within inner alloy liner with closed bottom 24*f*; wherein inner alloy liner with closed bottom 24*f* may be substantially sealed within granite components of waste-capsule 25, within drilled out void space 24*a*; wherein drilled out void space 24*a* may be surrounded by granite core cylinder 24*b*, solid support base 24*d*, and granite cap 24*c*; wherein these granite components of waste-capsule 25 may be encapsulated within outer lining of cylinder with closed bottom 24*g*; wherein outer lining of cylinder with closed bottom 24*g* may be inserted within carrier tube 34 (or within inner pipe 33); wherein carrier tube 34 (or inner pipe 33) may be within outer pipe 31; wherein outer pipe 31 may be within wellbores within deep disposal formation 16 and/or geologic formation 38. In some embodiments, disposed between the interior surfaces of deep disposal formation 16 and/or geologic formation 38 and outer pipe 31 may be injected cement 30*b*. In some embodiments, disposed between outer pipe 31 and carrier tube 34 (or inner pipe 33) with the waste-capsule 25 of FIG. 5 may be injected cement 30*a*. Thus, in some embodiments, there may be eight layers from and including deep disposal formation 16 and/or geologic formation 38 before reaching nuclear waste material 36: (1) deep disposal formation 16 and/or geologic formation 38; (2) cement 30*b*; (3) outer pipe 31; (4) cement 30*a*; (5) carrier tube 34 (or inner pipe 33); (6) outer lining of cylinder with closed bottom 24*g*; (7) granite components of waste-capsule 25 (e.g., granite core cylinder 24*b*); and (8) inner alloy liner with closed bottom 24*f*. In some embodiments, the granite components of waste-capsule 25 may form a closed "miniature granite repository" containing nuclear waste material 36 internally.

Figure 7:
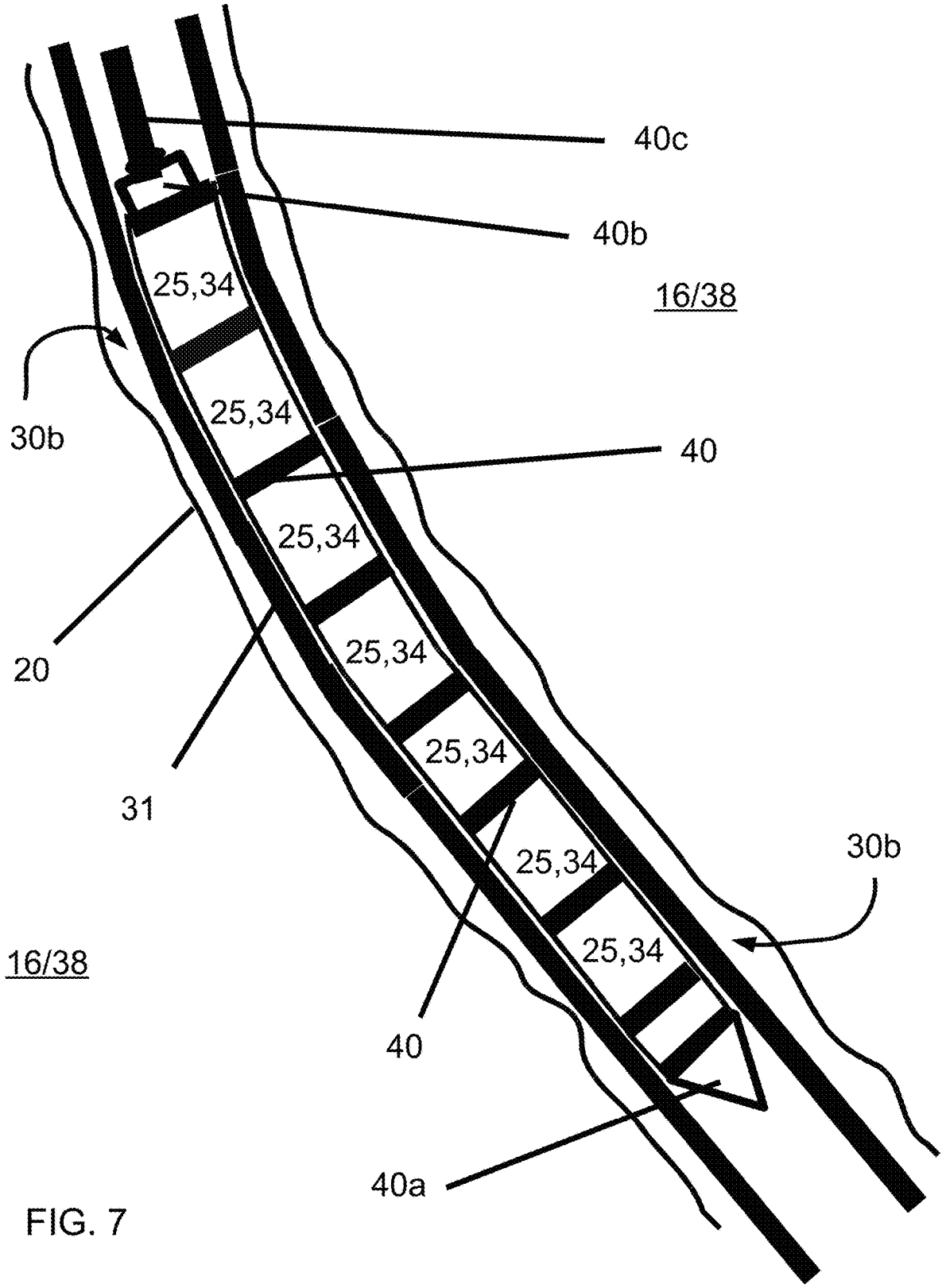
FIG. 7 may illustrate multiple substantially granite waste-capsules and connected devices which together make up a given waste-capsule "string" (referred to herein as a "chorizo") to be inserted into a given wellbore for long-term nuclear waste material (HLW, WGP and/or SNF) disposal and storage.

FIG. 7 may illustrate a series of waste-capsules 25 (each with nuclear waste 36 within its drilled out void space 24*a*) that may be connected sequentially and linearly to form an integral unit called herein, a "chorizo." In some embodiments, this chorizo structure may be landed (inserted and placed) into a given wellbore (e.g., 15, 20, and/or 20*a*) drilled into deep disposal formation 16 and/or geologic formation 38. In some embodiments, this chorizo system may allow several such waste-capsules 25 and their spacers and couplings 40 to form a longer cylindrical unit which may be implemented in drilling operations as an integral string which may be typical of the oilfield industry field processes. In some embodiments, a given coupling 40 may connect two adjacent waste-capsules 25 (may connect two adjacent carrier-tubes 34). In some embodiments, at a proximal end of the chorizo (with respect to drilling-rig 10) may be a landing tool device 40*c* which may allow an operator on earth surface 14 to insert, push, and/or direct the chorizo into the given wellbore (e.g., 15, 20, and/or 20*a*). In some embodiments, a detachable tool 40*b* may be a device which may be implemented to allow the chorizo with its waste-capsules 25 to be retrievable by using an industry standard "fishing tool" and pulled back to earth surface 14 from the given wellbore (e.g., 15, 20, and/or 20*a*) after they may have been sequestered in place. Fishing is an oil drilling industry term which may describe the operation of retrieving a piece of downhole equipment. In some embodiments, at a distal (terminal) end of the chorizo may an oilfield device (or like device) generally called a "sub," designated as guiding tool 40*a* in FIG. 7, which may guide the chorizo string allowing easier insertion in the cylindrical environment.

In some embodiments, this familiarity and commonality of widespread use of oil drilling industry tools, devices, and/or practices, in repurposed format, may allow the subject invention implemented herein to be utilized extremely economically without a need to devise or re-invent a whole new set of operational techniques.

In some embodiments, a final stopping (resting) location of a given chorizo within the wellbore system (e.g., 15, 20, and/or 20*a*) may be at least 5,000 feet below earth surface 14 and within deep disposal formation 16 and/or geologic formation 38.

In some embodiments, a final stopping (resting) location of a plurality of carrier tubes 34 (e.g., a given chorizo) within the wellbore system (e.g., 15, 20, and/or 20*a*) may be at least 5,000 feet below earth surface 14 and within deep disposal formation 16 and/or geologic formation 38. In some embodiments, each carrier tube 34 of the plurality of carrier tubes 34 may have a waste-capsule 25. In some embodiments, each such waste-capsule 25 may be holding nuclear waste material 36.

Figure 8:
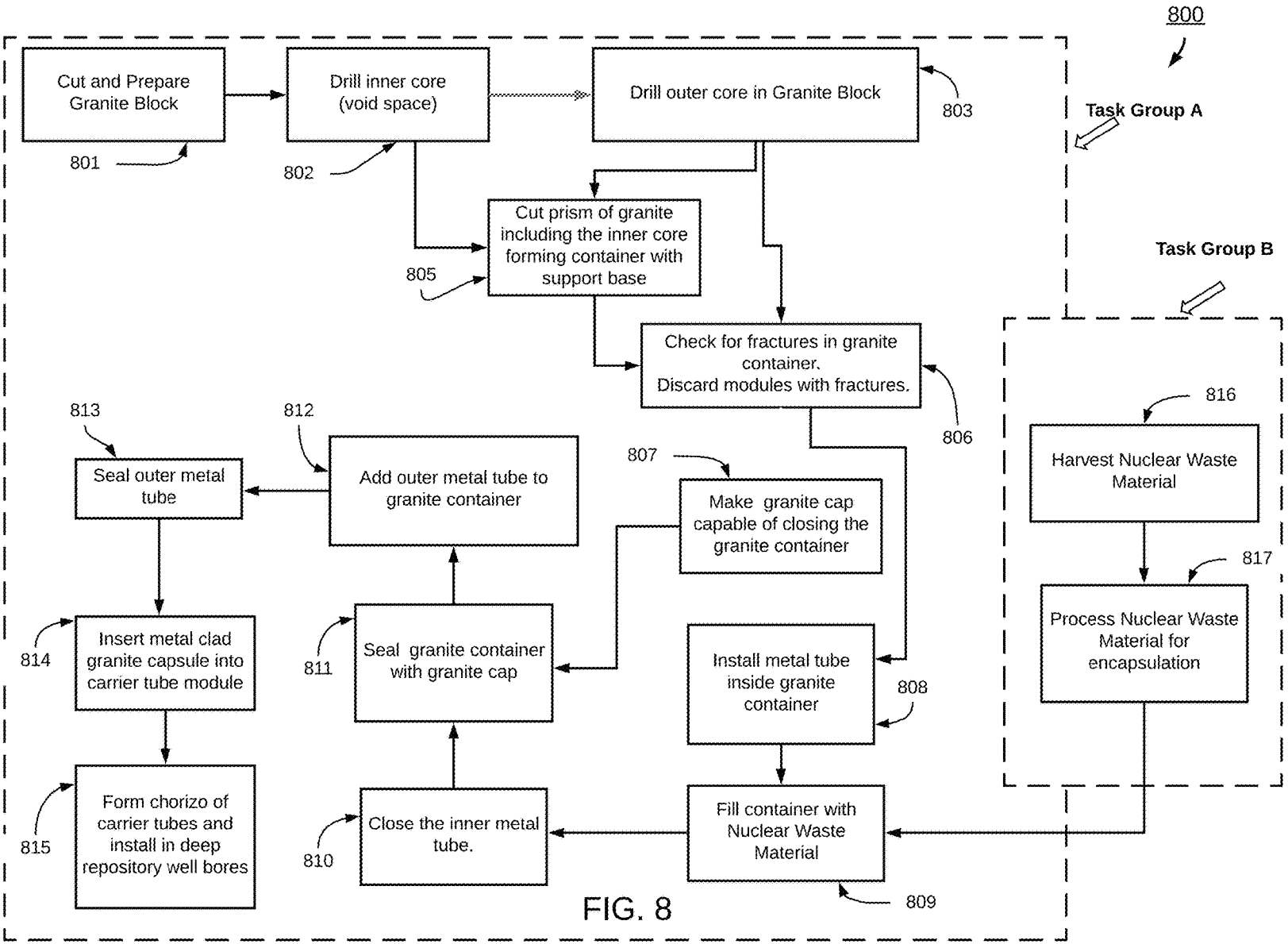
FIG. 8 may illustrate a flowchart showing the sequence of operations in processing the substantially granite based waste-capsule system from the commercial granite block and the insertion processes into the wellbores for final disposal and long-term storage of the nuclear waste material (HLW, WGP and/or SNF).

FIG. 8 may illustrate a flowchart showing the sequence of operations in processing the granite based waste core system from the commercial granite block and the insertion processes into the wellbores for final disposal and long-term storage of nuclear waste material 36. FIG. 8 may depict steps in method 800. In some embodiments, method 800 may be a method of nuclear waste long-term storage using granite capsules 800. In some embodiments, method 800 may be a method for handling nuclear waste for long-term storage. In some embodiments, method 800 may be a method for constructing waste-capsules 25 for the long-term storage of nuclear waste material 36. In some embodiments, method 800 may comprise two separate, but operationally linked task groups, Task Group A and Task Group B. In some embodiments, Task Group B may feed into a step of Task Group A. In some embodiments, Task Group A may comprise steps involved in preparing and placing waste-capsules 25. In some embodiments, Task Group B may comprise steps involved in harvesting and processing nuclear waste material 36 to long-term storage in the waste-capsules 25.

Continuing discussing FIG. 8, in some embodiments, Task Group A may comprise steps of: step 801, step 802, step 803, step 805, step 806, step 807, step 808, step 809, step 810, step 811, step 812, step 813, step 814, and step 815.

Continuing discussing FIG. 8, in some embodiments, Task Group B may comprise steps of: step 816 and step 817. In some embodiments, step 817 may feed into step 809.

Continuing discussing FIG. 8, in some embodiments, steps 801 through 814 may occur away from the subterranean storage location site; i.e., away from below where deep geological formation 16 and/or geologic formation 38 may be located. In some embodiments, forming the chorizo of carrier tubes 34, in step 815 may be performed at or proximate to drilling-rig 10 location or away. In some embodiments, inserting the chorizo of carrier tubes 34 of step 815 may begin at the drilling-rig 10 location and proceed into the various locations of the wellbores (e.g., 15, 20, and/or 20*a*).

Continuing discussing FIG. 8, in some embodiments step 816 and step 817 may occur at or remote from the subterranean storage location site. For example, and without limiting the scope of the present invention, step 816 may occur at or proximate to nuclear power plant 10*a* and/or to surface-storage-locations 10*b* (e.g., cooling pools). In some embodiments, step 817 may occur at any location, such as any location of earth surface 14.

Continuing discussing FIG. 8, in some embodiments, in step 801, a commercially available granite block 19 may be cut, quarried, prepared, and/or shaped for subsequent coring operations. In some embodiments, step 801 may include cleaning, polishing, and/or machining the outside surfaces of granite block 19 to allow for ease of storage, movement, coring, and/or cutting.

Continuing discussing FIG. 8, in some embodiments, step 801 may progress into step 802. In some embodiments, step 802 may be a step of drilling/coring of granite block 19 to form drilled out void space 24*a* within granite block 19 using a commercially available coring device 26. See e.g., FIG. 3A and FIG. 3B. In some embodiments, drilled out void space 24*a* may be substantially 6 inches in diameter. In some embodiments, a length of drilled out void space 24*a* may not extend to a bottom of granite block 19 such that solid support base 24*d* of granite block 19 may be formed at the closed end of drilled out void space 24*a*.

Continuing discussing FIG. 8, in some embodiments, step 802 may progress into step 803. In some embodiments, step 803 may be a step of drilling an outer core from the granite block 19 with the drilled out void space 24*a* to form granite core cylinder 24*b*. See e.g., FIG. 3A, FIG. 3B, and FIG. 4. In some embodiments, an outside diameter of granite core cylinder 24*b* may be substantially 8 inches or more. In some embodiments, step 803 may involve drilling/coring/cutting all the way through granite block 19 past and longer than drilled out void space 24*a*. In some embodiments, granite core cylinder 24*b* may be longer than drilled out void space 24*a* by solid support base 24*d*. In some embodiments, an end product of step 803 may be substantially cylinder shaped granite waste-capsule 25, with drilled out void space 24*a*, with granite core cylinder 24*b*, and with solid support base 24*d*.

Continuing discussing FIG. 8, in some embodiments, step 802 may progress into step 805. In some embodiments, step 805 may be a step of cutting the granite block 19 material around drilled out void space 24*a* to form a rectangular prism form of granite waste-capsule 25, with solid support base 24*d*. In some embodiments, an end product of step 805 may be substantially rectangular prism shaped granite waste-capsule 25, with drilled out void space 24*a* and with solid support base 24*d*. See e.g., FIG. 3A. In some embodiments, step 805 may be an alternative to step 803.

Continuing discussing FIG. 8, in some embodiments, step 803 may progress into step 806. In some embodiments, step 805 may progress into step 806. In some embodiments, step 806 may be a quality control step, checking for defects in formed granite waste-capsule 25. In some embodiments, step 806 may be a step of checking for undesired cracks and/or weak spots in formed granite waste-capsule 25. In some embodiments, step 806 may use various imaging techniques, such as, but not limited to, analytical electrical logging tools, deep penetrating radar, ultrasound, x-ray and/or the like. In some embodiments, such cracks and/or weaknesses may be undesired as they may permit undesired radionuclide migration.

Continuing discussing FIG. 8, in some embodiments, step 806 may progress into step 807. In some embodiments, step 807 may be a step of constructing granite cap 24*c* to cover and/or seal the granite waste-capsule 25. See e.g., FIG. 4. In some embodiments, granite cap 24*c* may also be tested for undesirable cracks and/or weak spots.

Continuing discussing FIG. 8, in some embodiments, step 807 may progress into step 808. In some embodiments, step 806 may progress into step 808. In some embodiments, step 808 may be a step of inserting inner alloy liner with closed bottom 24*f* inside of drilled out void space 24*a* of the granite waste-capsule 25. In some embodiments, step 808 may be optional. See e.g., FIG. 6.

Continuing discussing FIG. 8, in some embodiments, step 816 (a first step of Task Group B) may be a step of harvesting nuclear waste material 36 from sources which may or may not be remote from the final intended repository site.

Continuing discussing FIG. 8, in some embodiments, step 816 may progress into step 817. In some embodiments, step 817 may be a step of processing the harvested nuclear waste material 36 of step 816 to prepare it for suitable disposal. In some embodiments, step 817 substantially solidifies the harvested nuclear waste material 36 into a form which may minimize radionuclide dispersion or migration. In some embodiments, step 817 may be a step of processing the harvested nuclear waste material 36 into a substantially glass and/or ceramic form.

Continuing discussing FIG. 8, in some embodiments, step 817 may progress into step 809. In some embodiments, step 808 may progress into step 809, if step 808 was utilized. In some embodiments, if step 808 was not utilized, then step 807 and/or step 806 may progress into step 809. In some embodiments, step 809 may be a step of filling the substantially granite waste-capsule 25 with nuclear waste material 36, which may have been harvested and/or process according to steps 816 and 817, respectively. In some embodiments, step 809 may be a step of receiving into the substantially granite waste-capsule 25 the nuclear waste material 36, which may have been harvested and/or process according to steps 816 and 817, respectively. In some embodiments of step 809, if inner alloy liner with closed bottom 24*f* was utilized, then the nuclear waste material 36 may be received into inner alloy liner with closed bottom 24*f*, which may be in drilled out void space 24*a* of the given substantially granite waste-capsule 25. In some embodiments of step 809, if inner alloy liner with closed bottom 24*f* was utilized, then step 809 may occur prior to step 808, in which case, once step 809 occurs, then step 809 may progress to step 808 and then to step 810. See e.g., FIG. 4 or FIG. 6.

Continuing discussing FIG. 8, in some embodiments of step 809, if inner alloy liner with closed bottom 24*f* was not utilized, then the nuclear waste material 36 may be received directly into drilled out void space 24*a* of the given substantially granite waste-capsule 25. See e.g., FIG. 4.

Continuing discussing FIG. 8, in some embodiments, step 809 may progress into step 810, if inner alloy liner with closed bottom 24*f* was utilized. In some embodiments, if inner alloy liner with closed bottom 24*f* was utilized, then step 817 may have progressed into step 809, then to step 808, and then to step 810; i.e., the nuclear waste material 36 may be placed into inner alloy liner with closed bottom 24*f* prior to placing inner alloy liner with closed bottom 24*f* into drilled out void space 24*a* of the substantially granite waste-capsule 25. In some embodiments, step 810 may be a step of sealing inner alloy liner with closed bottom 24*f*. In some embodiments, conclusion of step 810 may result in the nuclear waste material 36 being entirely encapsulated within inner alloy liner with closed bottom 24*f*. In some embodiments, step 810 may be optional, i.e., step 810 may only be implemented if step 808 and/or inner alloy liner with closed bottom 24*f* was utilized. See e.g., FIG. 6.

Continuing discussing FIG. 8, in some embodiments, step 810 may progress into step 811. In some embodiments, step 811 may be a step of sealing the substantially granite waste-capsule 25 with granite cap 24*c*. In some embodiments, conclusion of step 811 may result in the nuclear waste material 36 being entirely encapsulated within the granite of waste-capsule 25 (e.g., entirely surrounded by granite core cylinder 24*b*, solid support base 24*d*, and granite cap 24*c*). See e.g., FIG. 4 and/or FIG. 6.

In some embodiments, where inner alloy liner with closed bottom 24*f*, step 808, and step 810 may not have been utilized, then step 809 may progress into step 811.

Continuing discussing FIG. 8, in some embodiments, step 811 may progress into step 812. In some embodiments, step 812 may be a step of placing the result of step 811 within outer lining of cylinder with closed bottom 24*g*. In some embodiments, step 812 may be optional. See e.g., FIG. 6.

Continuing discussing FIG. 8, in some embodiments, step 812 may progress into step 813. In some embodiments, step 813 may be a step of sealing outer lining of cylinder with closed bottom 24*g* completely. In some embodiments, step 813 may only be utilized if step 812 was performed. See e.g., FIG. 6.

Continuing discussing FIG. 8, in some embodiments, step 813 may progress into step 814. In some embodiments, step 814 may be a step of inserting the product of step 813 within a carrier tube 34 (or within an inner pipe 33). See e.g., FIG. 6.

In some embodiments, where outer lining of cylinder with closed bottom 24*g*, step 812, and step 813 were not utilized, then step 811 may progress into step 814. In some embodiments, step 814 may be a step of inserting the product of step 811 within the carrier tube 34 (or within the inner pipe 33).

Continuing discussing FIG. 8, in some embodiments, step 814 may progress into step 815. In some embodiments, step 815 may be a step of connecting (e.g., with couplings 40) a sequence of carrier tubes 34 (products from step 814) together into a chain or a string, referred to a chorizo; and landing (inserting and placing) such a chorizo within the given wellbore (e.g., 15, 20, and/or 20*a*). See e.g., FIG. 1 and FIG. 7.

In some embodiments, any of the granite structures noted, shown, and discussed herein may be replaced with granite like materials, that may have similar very low porosity, similar very low permeability, similar durability, similar strength, and/or similar rigidity, such as, but not limited to some other types of ingenious rocks.

In some embodiments, any of the granite structures noted, shown, and discussed herein may be replaced with granite like materials, that may have similar very low porosity, similar very low permeability, similar durability, similar strength, and/or similar rigidity, such as, but not limited to some types of ceramics, composites, and/or laminates.

Systems and methods for deep geological storage of nuclear waste that utilize a specially formed substantially granite (or the like) capsule/container have been described. The preceding description of the various embodiments of the invention has been presented for the purposes of illustration and disclosure. It is not intended to be exhaustive or to limit the invention to the precise form disclosed. Many modifications and variations are possible in light of the above teaching without departing from the spirit of the invention.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A system for long-term storage of nuclear waste materials, the system comprising:

a waste-capsule for receiving a quantity of the nuclear waste materials, wherein the waste-capsule is substantially constructed of granite, with granite side-walls and a granite bottom, wherein the granite side-walls extend from the granite bottom, such that disposed within the granite side-walls and the granite bottom is a drilled out void space, wherein the drilled out void space receives the quantity of the nuclear waste materials.

2. The system according to claim 1, wherein the waste-capsule that is substantially constructed of granite is formed from a single quarried granite block.

3. The system according to claim 1, the granite side-walls and the granite bottom are integral with respect to each other being formed from a single quarried granite block.

4. The system according to claim 1, wherein the waste-capsule comprises a granite cap for attaching to a top of the granite side-walls for sealing the drilled out void space.

5. The system according to claim 1, wherein the waste-capsule is formed by first coring a region of a quarried granite block to form the drilled out void space; wherein this first coring is to a first depth in the quarried granite block; wherein this first depth is less than a height of the quarried granite block; wherein around and including the drilled out void space, the quarried granite block is then cut to form the granite side-walls of the waste-capsule; wherein this cutting is to a second depth in the quarried granite block; wherein this second depth is longer than the first depth; wherein this second depth is substantially the same as the height of the quarried granite block.

6. The system according to claim 5, wherein the cutting is a second coring such that the formed granite side-walls are substantially cylindrical in shape.

7. The system according to claim 5, wherein the cutting forms the granite side-walls into a substantially rectangular prism shape.

8. The system according to claim 1, wherein the system further comprises an inner alloy liner with closed bottom that is inserted into the drilled out void space; wherein an interior of the inner alloy liner with closed bottom receives the quantity of nuclear waste material such that the quantity of nuclear waste material is in direct physical contact with the interior of the interior of the inner alloy liner; and the drilled out void space contains both the inner alloy liner with closed bottom and the quantity of the nuclear waste material.

9. The system according to claim 8, wherein the inner alloy liner with closed bottom is substantially constructed from a corrosion resistant metal or metal alloy.

10. The system according to claim 8, wherein the inner alloy liner with closed bottom is substantially constructed from copper or a copper alloy.

11. The system according to claim 1, wherein the system further comprises an outer lining of cylinder with closed bottom; wherein the outer lining of cylinder with closed bottom substantially encloses the waste-capsule once the waste-capsule has been sealed with a granite cap.

12. The system according to claim 1, wherein the system further comprises a carrier tube for receiving the waste-capsule; wherein the carrier tube is configured to be landed within an interior of a wellbore.

13. The system according to claim 1, wherein the system further comprises a plurality of carrier tubes, wherein the plurality of carrier tubes are arranged in a linear fashion with any two adjacent carrier tubes from the plurality of carrier tubes are connected to each other by a coupling, wherein the plurality of carrier tubers terminates in a guiding tool and disposed opposite of the guiding tool the system further comprises a landing tool that is removably connected to a proximal end of the plurality of carrier tubes; wherein each carrier tube selected from the plurality of carrier tubes is housing at least one of the waste-capsule; wherein the plurality of carrier tubes is configured to be landed within an interior of a wellbore using the landing tool and using the guiding tool to facilitate translation of the plurality of carrier tubes through the interior of the wellbore.

14. The system according to claim 13, wherein a final stopping location of the plurality of carrier tubes within the interior of the wellbore is at least 5,000 feet below a surface of the land and within a deep geological formation.

15. The system according to claim 1, wherein the granite side-walls and the granite bottom are at least two inches thick.

16. The system according to claim 1, wherein the drilled out void space is at least six inches in diameter.

17. A method for long-term storage of nuclear waste using at least one waste-capsule that is substantially constructed of granite, the method comprising steps of:

(a) preparing a granite block for coring and cutting operations;

(b) coring an inner most core out from the granite block, that has been prepared, to form a drilled out void space that is for receiving a quantity of the nuclear waste material;

(c) cutting an area of the granite block around the drilled out void space to form granite side-walls and a granite bottom; wherein an end product of this cutting step is formation of the least one waste-capsule;

(d) placing the quantity of the nuclear waste material into the drilled out void space;

(e) sealing the drilled out void space with the quantity of the nuclear waste material with a granite cap to form a sealed at least one waste-capsule;

(f) inserting the sealed at least one waste-capsule into a carrier tube of pre-determined length and diameter;

(h) sealing the carrier tube by predetermined means to form a sealed carrier tube; and (i) inserting the sealed carrier tube into a wellbore at a predetermined depth.

18. The method according to claim 17, wherein prior to the placing step (d), the nuclear waste material is harvested and processed into a substantially solid state.

19. The method according to claim 17, wherein steps (b) through (h) are repeated to form at least two different sealed carrier tubes; wherein step (i) then progress as inserting the at least two different sealed carrier tubes into the wellbore to the predetermined depth.

20. The method according to claim 17, wherein the step (d) further comprises that the quantity of nuclear material is inserted into an inner alloy liner with closed bottom and the inner alloy liner with closed bottom with the quantity of nuclear material is placed into the drilled out void space to complete step (d); and wherein this inner alloy liner with closed bottom is sealed prior to step (e) of sealing the at least one waste-capsule with the granite cap.

* * * * *